US009333535B2

(12) United States Patent
Barkin et al.

(10) Patent No.: US 9,333,535 B2
(45) Date of Patent: May 10, 2016

(54) MUT CIRCUIT WITH AN ELECTRICALLY CONTROLLABLE MEMBRANE

(75) Inventors: David Brian Barkin, San Francisco, CA (US); Joshua Posamentier, Oakland, CA (US); Ira Oaktree Wygant, Palo Alto, CA (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 1070 days.

(21) Appl. No.: 13/356,993

(22) Filed: Jan. 24, 2012

(65) Prior Publication Data

US 2013/0188458 A1 Jul. 25, 2013

(51) Int. Cl.
*B06B 1/02* (2006.01)

(52) U.S. Cl.
CPC ..... *B06B 1/0207* (2013.01); *B06B 2201/30* (2013.01); *B06B 2201/51* (2013.01); *B06B 2201/55* (2013.01)

(58) Field of Classification Search
CPC ..... B06B 1/02
USPC ..... 367/140
See application file for complete search history.

(56) References Cited

U.S. PATENT DOCUMENTS

| | | | | |
|---|---|---|---|---|
| 4,333,028 | A * | 6/1982 | Panton | 310/326 |
| 4,417,098 | A * | 11/1983 | Chaplin et al. | 381/71.12 |
| 2005/0215909 | A1* | 9/2005 | Barnes | 600/459 |
| 2006/0075818 | A1* | 4/2006 | Huang et al. | 73/649 |
| 2007/0167782 | A1* | 7/2007 | Callahan et al. | 600/443 |
| 2010/0251823 | A1* | 10/2010 | Adachi et al. | 73/606 |
| 2011/0068654 | A1* | 3/2011 | Cheng et al. | B06B 1/0292 310/300 |

* cited by examiner

*Primary Examiner* — Luke Ratcliffe
*Assistant Examiner* — Amienatta M Ndure Jobe
(74) *Attorney, Agent, or Firm* — John R. Pessetto; Frank D. Cimino

(57) ABSTRACT

A micromachined ultrasonic transducer (MUT) circuit, which has a MUT with a MUT membrane that can vibrate back and forth to transmit an ultrasonic wave, electrically controls the movement of the MUT membrane by controllably transferring energy to the MUT membrane, thereby allowing the MUT membrane to transmit substantially any desired ultrasonic wave.

20 Claims, 4 Drawing Sheets

MUT CIRCUIT WITH AN ELECTRICALLY CONTROLLABLE MEMBRANE

BACKGROUND OF THE INVENTION

1. Field of the Invention

The present invention relates to MUTs and, more particularly, to a MUT circuit with an electrically controllable membrane.

2. Description of the Related Art

A transducer is a device that converts an electrical signal into a type of energy, such as acoustic energy, and converts the type of energy, such as the acoustic energy, into an electrical signal. A micromachined ultrasonic transducer (MUT) is a micromachined transducer that converts an electrical signal into a transmitted ultrasonic wave, and converts a received ultrasonic wave into an electrical signal.

The basic component of a MUT is a suspended membrane or diaphragm which is capable of vibrating. When the membrane vibrates due to electrical stimulation, the membrane outputs ultrasonic waves. On the other hand, when the membrane vibrates due to an incoming ultrasonic wave, the movement of the membrane generates an electrical signal or a change in a measurable electrical property of the device. Two common types of MUTs are a capacitive MUT (CMUT), and a piezoelectric MUT (PMUT).

FIG. 1 shows a schematic diagram that illustrates an example of a MUT circuit 100 in accordance with the present invention. As shown in FIG. 1, MUT circuit 100 includes a MUT 110, which has a MUT membrane 112 that can vibrate back and forth in a down direction D1 to a down position P1, and in an up direction D2 opposite to the down direction D1 to an up position P2. MUT 110 can be implemented with any MUT, such as a CMUT or a PMUT.

As further shown in FIG. 1, MUT circuit 100 includes a transmit circuit 114, a receive circuit 116, and a digital signal processing circuit 118. Transmit circuit 114 and receive circuit 116 are both electrically connected to MUT membrane 112, while digital signal processing circuit 118 is electrically connected to receive circuit 116.

For example, transmit circuit 114 can be implemented with a pulse generator 120 that is electrically connected to MUT membrane 112, and a controller 122 that is electrically connected to pulse generator 120. Receive circuit 116, in turn, can be implemented with an amplifier/filter circuit 124, and an analog-to-digital (A/D) converter 126 that is electrically connected to amplifier/filter circuit 124 and digital signal processing circuit 118.

In operation, when MUT circuit 100 transmits, controller 122 commands pulse generator 120 to output a voltage pulse VP to MUT membrane 112. The voltage pulse VP, in turn, causes MUT membrane 112 to vibrate at the natural mechanical resonant frequency of MUT 110, and thereby generate an ultrasonic wave UW at that frequency.

FIGS. 2A-2B are timing diagrams that illustrate an example of the transmission operation of MUT circuit 100 in accordance with the present invention. FIG. 2A shows a timing diagram that illustrates a voltage pulse VP, while FIG. 2B shows a timing diagram that illustrates an example of an ultrasonic wave UW that is generated by MUT 110 in response to the voltage pulse VP. The x-axis represents time in FIG. 2A, while the y-axis represents voltage amplitude. The x-axis represents an at-rest position of MUT membrane 112 in FIG. 2B, while the y-axis represents the acoustic amplitude or the physical movement of MUT membrane 112.

As shown in FIG. 2A, when MUT circuit 100 transmits, a voltage pulse VP causes MUT membrane 112 to vibrate and generate an ultrasonic wave UV at the natural mechanical resonant frequency of MUT 110. In addition, as further shown in FIG. 2B, the amplitude of each ultrasonic wave UW decays over time based on the physical dampening mechanism of MUT 110, and substantially goes to zero before the next voltage pulse VP occurs.

When MUT circuit 100 receives, an incoming ultrasonic wave causes MUT membrane 112 to vibrate. The vibration of MUT membrane 112 generates an electrical signal or a change in a measurable electrical property of the device that causes an output voltage to vary. Amplifier/filter circuit 124 amplifies and filters the varying output voltage, while A/D converter 126 generates a digitized signal that represents the varying output voltage. The digitized signal is then processed by digital signal processing circuit 118 as required by the application to generate, for example, an ultrasonic image or a simple distance measurement.

Although MUT circuit 100 works well for numerous applications, such as contact or near contact body imaging applications like echo cardiograms, MUT circuit 100 lacks sufficient bandwidth for some airborne applications. Thus, there is a need for a MUT circuit which can operate in those airborne applications that require a larger bandwidth.

BRIEF DESCRIPTION OF THE DRAWINGS

FIG. 2A is a timing diagram illustrating an example of a voltage pulse VP.

FIGS. 4A-4B are timing diagrams illustrating an example of the transmission operation of MUT circuit 300 in accordance with the present invention. FIG. 4A is a timing diagram illustrating an example of a transmit signal TS. FIG. 4B is a timing diagram illustrating an ultrasonic wave UW that is generated by MUT 310 in response to the transmit signal TS.

DETAILED DESCRIPTION OF THE INVENTION

Figure 3:
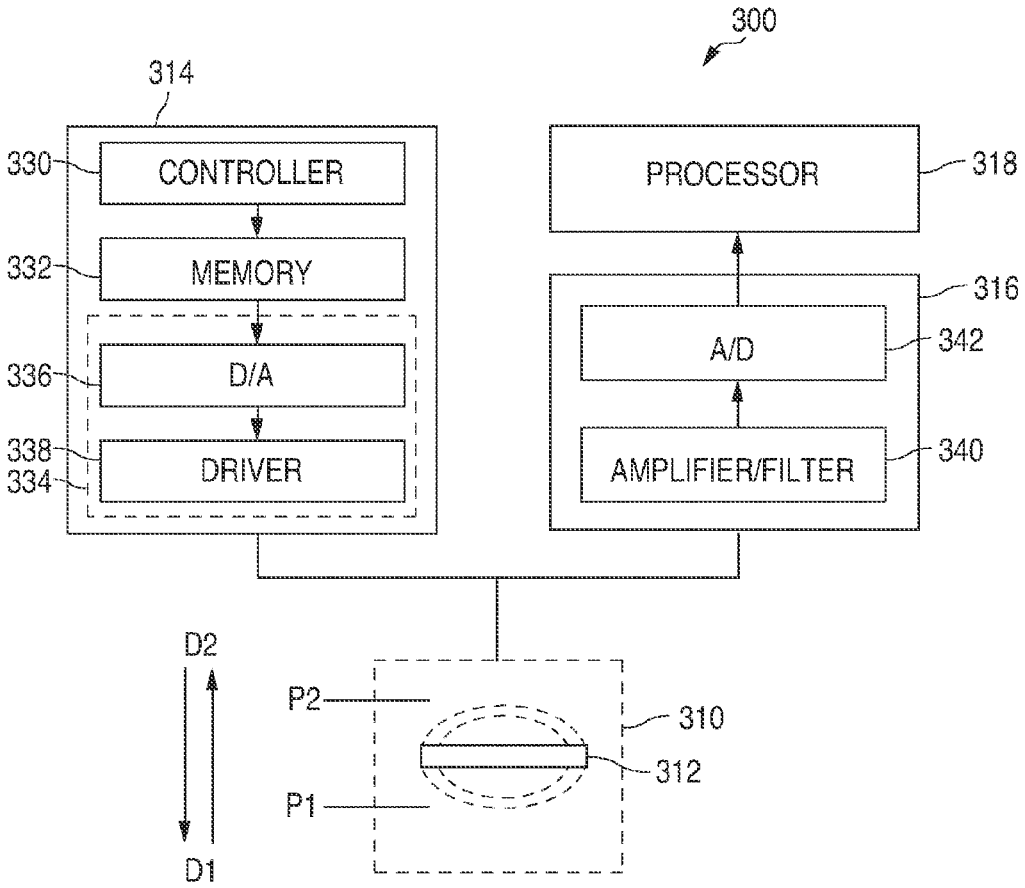
FIG. 3 is a schematic diagram illustrating an example of a MUT circuit 300 in accordance with the present invention.

FIG. 3 shows a schematic diagram that illustrates an example of a MUT circuit 300 in accordance with the present invention. As described in greater detail below, MUT circuit 300 electrically controls the movement of the membrane that transmits the ultrasonic waves, thereby allowing the membrane to transmit substantially any desired ultrasonic wave.

As shown in FIG. 3, MUT circuit 300 includes a MUT 310, which has a MUT membrane 312 that can vibrate from an at-rest position back and forth in a down direction D1 to a down position P1, and in an up direction D2 opposite the down direction D1 to an up position P2. MUT 310 can be implemented with any MUT device, such as a CMUT or a PMUT.

As further shown in FIG. 3, MUT circuit 300 includes a transmit circuit 314 that is electrically connected to MUT membrane 312, a receive circuit 316 that is electrically connected to MUT membrane 312, and a digital signal processing circuit 318 that is electrically connected to receive circuit 316.

In the present example, transmit circuit 314 includes a controller 330, a memory 332 that is electrically connected to controller 330, and a driver circuit 334 that is electrically connected to MUT membrane 312 and memory 332. Driver circuit 334, in turn, is implemented with a digital-to-analog (D/A) converter 336 that is electrically connected to the output of memory 332, and a driver 338 that is electrically connected to MUT membrane 312 and the output of D/A converter 336. In addition, receive circuit 316 includes an amplifier/filter circuit 340, and an analog-to-digital (A/D) converter 342 that is electrically connected to processing circuit 318 and amplifier/filter circuit 340.

In operation, when MUT circuit 300 transmits, a transmit signal is stored as a series of digital values in a series of memory locations in memory 332. Controller 330 commands memory 332 to sequentially output the series of digital values that are stored in the series of memory locations to D/A converter 336, which converts the stored digital values into an analog signal.

The analog signal is then amplified and driven by driver 338 onto or across MUT membrane 312 as the transmit signal. The transmit signal transfers energy to MUT membrane 312, which causes MUT membrane 312 to vibrate due to the high quality factor (Q) of the mechanical system around its resonant frequency.

Figure 4A:
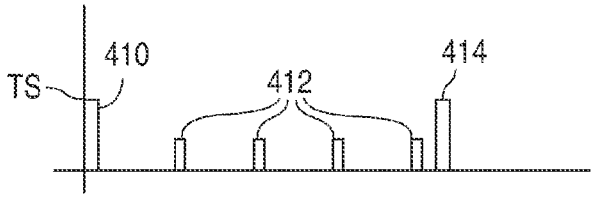
Figure 4B:
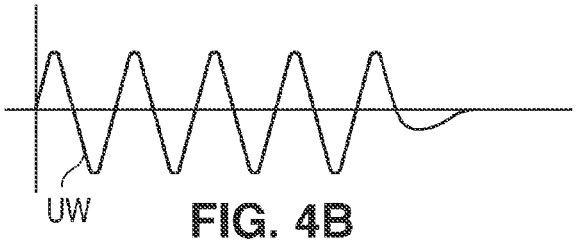
FIG. 4B is a timing diagram illustrating an ultrasonic wave UW that is generated by MUT 110 in response to the voltage pulse VP.

FIGS. 4A-4B are timing diagrams that illustrate an example of the transmission operation of MUT circuit 300 in accordance with the present invention. FIG. 4A shows a timing diagram that illustrates an example of a transmit signal TS, while FIG. 4B shows a timing diagram that illustrates an example of an ultrasonic wave UW that is generated by MUT 310 in response to the transmit signal TS. The x-axis represents time in FIG. 4A, while the y-axis represents voltage amplitude. The x-axis represents an at-rest position of MUT membrane 312 in FIG. 4B, while the y-axis represents the acoustic amplitude or the physical movement of MUT membrane 312.

As shown in FIG. 4A, when memory 332 begins outputting digital values, the transmit signal TS output by driver 338 has a number of voltage waveforms that each transfer energy to MUT membrane 312. As further shown in FIG. 4A, the transmit signal TS has an initial voltage waveform 410 that transmits and transfers an initial amount of energy to MUT membrane 312.

The initial voltage waveform 410 can have any shape and duration required to transfer the required energy. In the present example, the initial voltage waveform 410 transfers energy that is equal to or less than the maximum energy that is required to move MUT membrane 312 to its maximum point of deflection. In the present example, the initial voltage waveform 410 is illustrated in FIG. 4A as a positive pulse for simplicity.

The initial amount of energy transmitted to MUT membrane 312 causes MUT membrane 312 to first move in one direction from the at-rest position to an initial position (e.g., position P1 or P2), and then move in the opposite direction from the initial position to a next position (e.g., position P1 or P2). As shown in FIG. 4B, the back and forth movement of MUT membrane 312 in the down and up directions D1 and D2, which occurs at the natural mechanical resonant frequency of MUT 310, generates the ultrasonic wave UW at that frequency.

In the present example, in addition to the initial voltage waveform 410, the transmit signal TS also has one or more additional voltage waveforms 412 that each transmits and transfers an additional amount of energy to MUT membrane 312 after MUT membrane 312 has moved to the initial position. The additional voltage waveforms 412 can be the same or different to transfer the same or differing amounts of energy to MUT membrane 312.

As further shown in FIG. 4A, in the present example, each additional voltage waveform 412 transfers energy to MUT membrane 312 during a time that MUT membrane 312 moves in the same direction as when MUT membrane 312 responded to the initial voltage waveform 410. In addition, each additional voltage waveform 412 transmits a smaller amount of energy to MUT membrane 312 than the initial voltage waveform 410, but an amount that is sufficient to drive MUT membrane 312 to substantially the same down position P1 or up position P2 as when MUT membrane 312 first responded to the initial voltage waveform 410.

Further, each additional voltage waveform 412 can have any shape and duration required to transfer the necessary energy to MUT membrane 312. In the present example, the additional voltage waveforms 412 are illustrated in FIG. 4A as positive pulses for simplicity. Further, although four additional voltage waveforms 412 are shown, any number of additional waveforms can be used at any time.

Thus, the initial voltage waveform 410 and a number of additional voltage waveforms 412 can be used to form a multi-cycle ultrasonic wave where each ultrasonic cycle has substantially the same amplitude (and MUT membrane 312 moves substantially the same distance away from the at-rest position, measured orthogonally from the at-rest position). Multiple equal-amplitude ultrasonic cycles transmit the maximum amount of ultrasonic energy in the shortest period of time.

In addition, after the initial voltage waveform 410 and any additional voltage waveforms 412, the transmit signal TS output by driver 338 has a cancellation waveform 414 that transmits and transfers a cancellation amount of energy to MUT membrane 312 which is sufficient to substantially stop MUT membrane 312 at the at-rest position. As shown in FIG. 4B example, the cancellation voltage waveform 416 can distort the last half-cycle of the ultrasonic waveform UW.

As shown in FIG. 4A, the cancellation voltage waveform 414 transfers energy to MUT membrane 312 during a time that MUT membrane 312 moves in the opposite direction as when MUT membrane 312 responded to the initial voltage waveform 410. In addition, the cancellation voltage waveform 414 transmits a larger amount of energy to MUT membrane 312 than an additional voltage waveform 412. Further, the cancellation voltage waveform 414 can have any shape and duration required to transfer the necessary energy to MUT membrane 312. In the present example, the cancellation voltage waveform 414 is illustrated in FIG. 4A as a positive pulse for simplicity.

Thus, one advantage of MUT circuit 300 is that MUT circuit 300 allows an ultrasonic wave to be transmitted that has a number of cycles which have substantially the same amplitude, thereby transmitting the maximum amount of acoustic energy in the shortest period of time. In addition, another advantage of MUT circuit 300 is that MUT circuit 300 can substantially stop the ultrasonic wave after the number of cycles have been transmitted.

Figure 1:
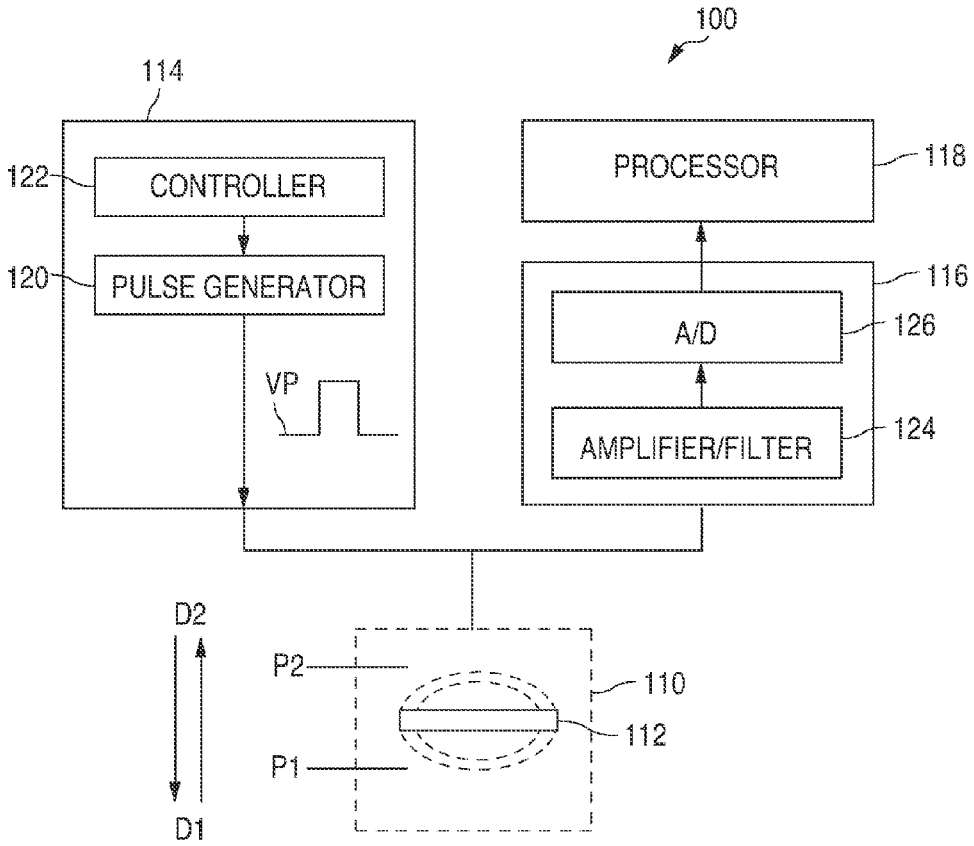
FIG. 1 (PRIOR ART)
FIG. 1 is a schematic diagram illustrating an example of a prior-art MUT circuit 100.
Figure 2A:
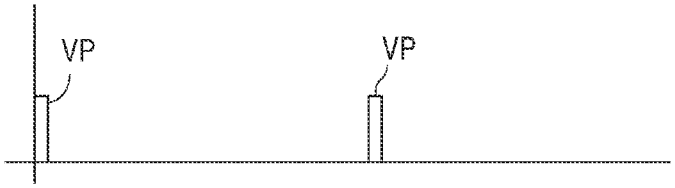
FIG. 2A (PRIOR ART)
FIGS. 2A-2B are timing diagrams illustrating an example of the transmission operation of MUT circuit 100.
Figure 2B:
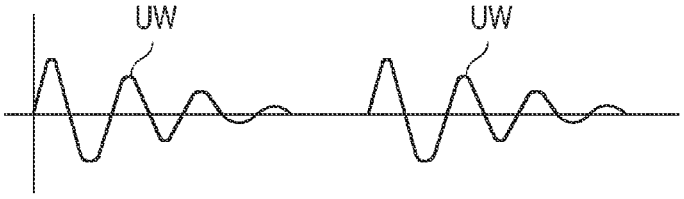
FIG. 2B (PRIOR ART)

MUTs which are used in medical imaging applications utilize relatively high frequencies, and have wider fractional bandwidths which are often as high as 100%. At a result, the time required for a pulsed membrane to stop vibrating due to the inherent dampening (as illustrated in FIG. 2B) is relatively short. However, because the mechanical impedance of air is very low compared to liquids, airborne ultrasound transducers often have a far higher mechanical Q than immersion transducers (takes a significantly longer period of time to stop vibrating in response to the inherent dampening), and therefore have a narrow bandwidth.

Thus, the advantage of substantially stopping the ultrasonic wave is that substantially stopping MUT membrane 312 eliminates the long period of mechanical oscillation caused by the higher mechanical Q factor of MUT 310, increases the effective system bandwidth of MUT 310, and allows MUT 310 to generate shorter transmit pulses.

The series of digital values stored in the series of memory locations in memory 332, which represent the transmit signal TS, including the initial voltage waveform 410, any additional voltage waveforms 412, and the cancellation voltage waveform 414, can be determined by an external tester.

For example, controller 330 can load a test signal into memory 332 as a series of digital values, and then command memory 332 to output the series of digital values. D/A converter 336 converts the series of digital values into an analog signal, which is then amplified and driven by driver 338 onto or across MUT membrane 312 as the test signal.

The test signal causes MUT membrane 312 to vibrate, which generates a test ultrasonic wave. The external tester receives the test ultrasonic wave, and transduces the test ultrasonic wave to form a membrane electrical signal. The external tester also amplifies, filters, and digitizes the membrane electrical signal to form a digitized test signal. In addition, the external tester also compares the digitized test signal to a digitized golden signal.

The series of digital values can then be changed as needed and the process repeated until a good test signal is identified that generates a good test ultrasonic wave, which is received, transduced, amplified, filtered, and digitized by the external tester to form a digitized test signal that matches the digitized golden signal (within an error tolerance).

After a good digitized test signal has been identified, the series of digital values that represent the corresponding good test signal are written into memory 332 by controller 330 as the transmit signal. Computer modeling and simulation as well as prior test results can limit the number of test signals which must be generated for testing.

The ultrasonic wave UW illustrated in FIG. 4B is only one example of an ultrasonic wave that can be produced by a transmit signal. A wide variety of ultrasonic waveforms can be formed by selecting the transmit signal that is stored in memory 332. The transmit signal that is stored in memory 332 can generate any combination of electrical waveforms to transfer various amounts of energy at various times as needed to MUT membrane 312 to realize substantially any ultrasonic waveform.

When MUT circuit 300 receives, an incoming ultrasonic wave causes MUT membrane 312 to vibrate. The vibration of MUT membrane 312 generates an electrical signal or a change in a measurable electrical property of the device that causes an output voltage to vary. Amplifier/filter circuit 340 amplifies and filters the varying output voltage, while A/D converter 342 generates a digitized signal that represents the varying output voltage. The digitized signal is then processed by digital signal processing circuit 318 as required by the application to generate, for example, an ultrasonic image or a simple distance measurement.

Figure 5:
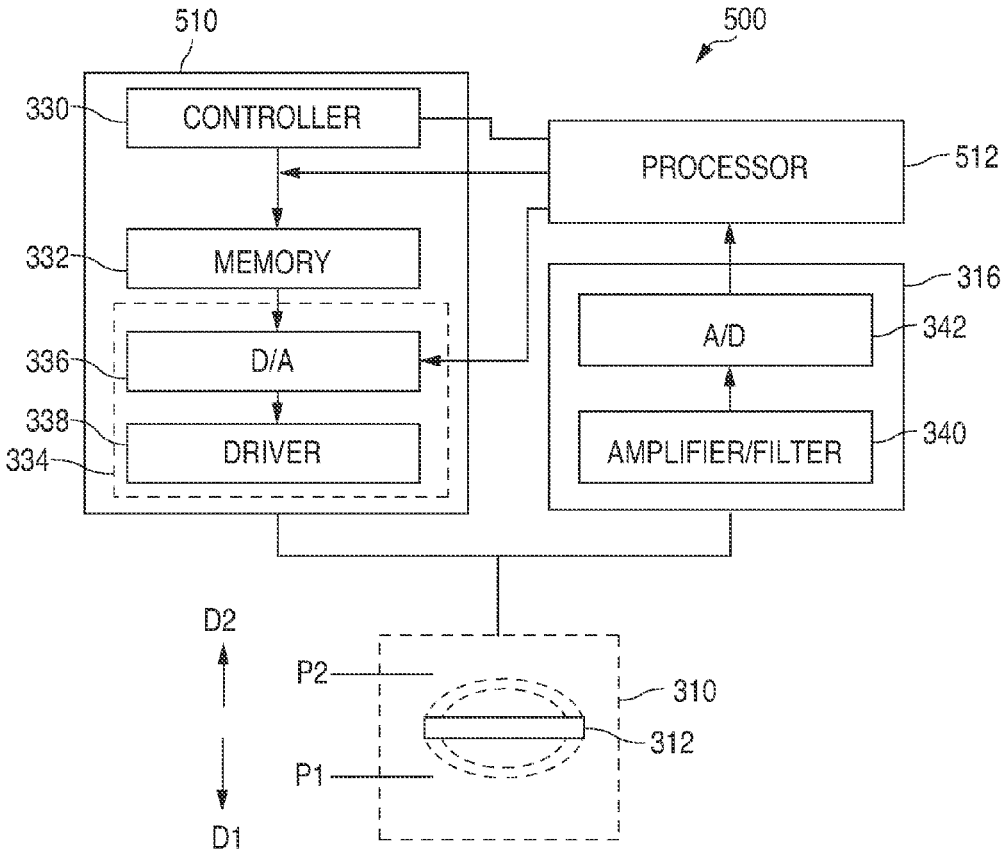
FIG. 5 is a schematic diagram illustrating an example of a MUT circuit 500 in accordance with an alternate embodiment of the present invention.

FIG. 5 shows a schematic diagram that illustrates an example of a MUT circuit 500 in accordance with an alternate embodiment of the present invention. MUT circuit 500 is similar to MUT circuit 300 and, as a result, utilizes the same reference numbers to designate the elements which are common to both MUT circuits.

As shown in FIG. 5, MUT circuit 500 differs from MUT circuit 300 in that MUT circuit 500 utilizes a transmit circuit 510 in lieu of transmit circuit 314, and a digital signal processing circuit 512 in lieu of digital signal processing circuit 318. Transmit circuit 510 is the same as transmit circuit 314, except that controller 330 of transmit circuit 510 passes control to digital signal processing circuit 512 at predetermined times, such as upon start up or under command, to determine the transmit signal to be stored in memory 332.

Once control has been received, digital signal processing circuit 512 sequentially outputs a series of digital values to D/A converter 336, which then converts the series of digital values into an analog signal. The analog signal is then amplified and driven by driver 338 onto or across MUT membrane 312 as a test signal.

The test signal causes MUT membrane 312 to vibrate, which generates a test ultrasonic wave, a portion of which is reflected back from a test structure. After MUT membrane 312 has stopped in the at-rest position, the reflected ultrasonic wave from the test structure causes MUT membrane 312 to again vibrate. The vibration of MUT membrane 312 generates an electrical signal or a change in a measurable electrical property of the device that causes the output voltage to vary.

Receive circuit 316 detects the varying output voltage, and generates a digitized signal that represents the varying output voltage. In the present example, the varying output voltage is amplified and filtered by amplifier/filter 340, and digitized by A/D converter 342 to form a digitized signal. Digital signal processing circuit 512 then compares the digitized signal to the digitized golden signal.

When the digitized signal matches the digitized golden signal within an error tolerance, the series of digital values that represent the test signal are written into memory 332 by digital signal processing circuit 512 as the transmit signal. Digital signal processing circuit 512 then passes control back to controller 330.

When the digitized signal fails to match the digitized golden signal within the error tolerance, digital signal processing circuit 512 changes the series of digital values output by digital signal processing circuit 512 to generate a different test signal, and continues generating different test signals until a digitized signal matches the digitized golden signal within the error tolerance.

When the digitized signal matches the digitized golden signal within the error tolerance, the series of digital values that represent the test signal are written into memory 332 by digital signal processing circuit 512 as the transmit signal. Digital signal processing circuit 512 then passes control back to controller 330. Computer modeling and simulation as well as prior test results can limit the number of different test signals that must be generated for testing. Alternately, optimization algorithms, such as a Least Mean Square (LMS) optimization, can be used to determine the test signal that must be generated for testing.

One of the advantages of MUT circuit 500 is that digital signal processing circuit 512 of MUT circuit 500 performs a calibration procedure that allows the series of digital values that are stored in memory 332, which represent the transmit signal, to be determined at predetermined times or upon command. As a result, MUT circuit 500 can compensate for changes, such as temperature and pressure, which can affect the accuracy of MUT 310.

Alternately, rather than utilizing a reflected ultrasonic wave, the output voltage from MUT membrane 312, which results from the movement of MUT membrane 312, can be used by receive circuit 316 to generate a digitized signal. For example, the output voltage can be amplified and filtered by amplifier/filter 340, digitized by A/D converter 342, and then compared to the digitized golden signal by digital signal processing circuit 512 during the intervals between the initial voltage waveform 410, the additional voltage waveforms 412, and the cancellation voltage waveform 414.

Figure 6:
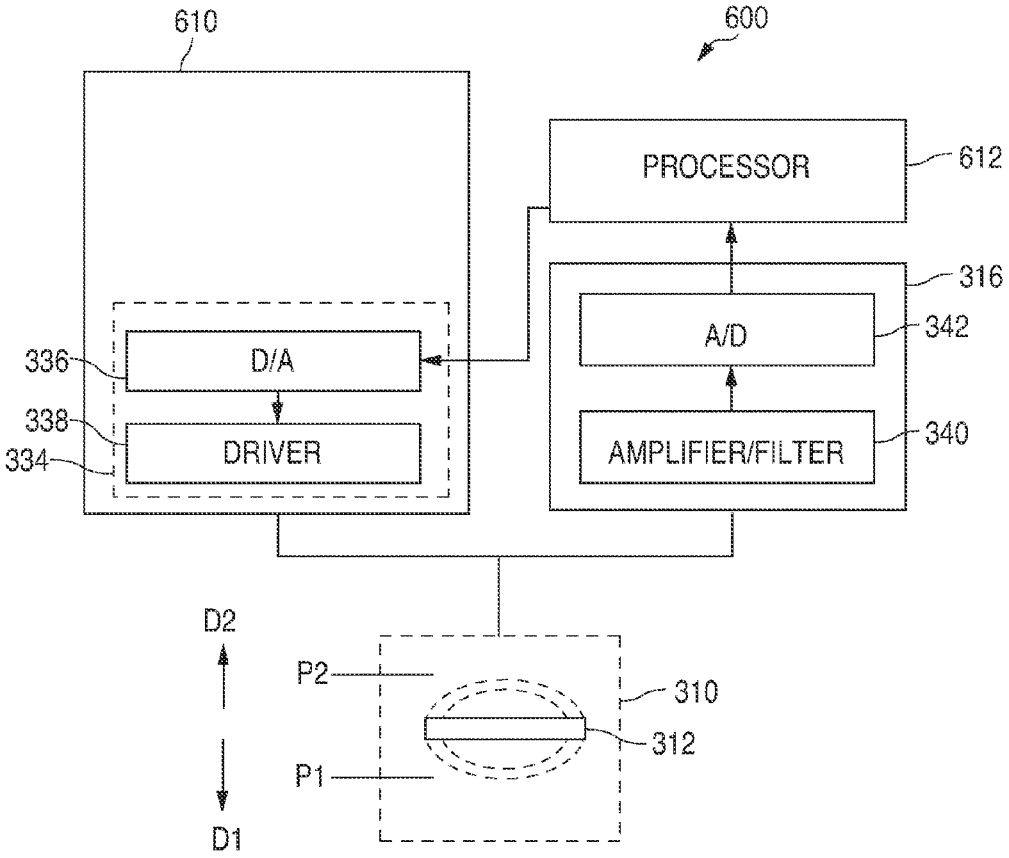
FIG. 6 is a schematic diagram illustrating an example of a MUT circuit 600 in accordance with an alternate embodiment of the present invention.

FIG. 6 shows a schematic diagram that illustrates an example of a MUT circuit 600 in accordance with an alternate embodiment of the present invention. MUT circuit 600 is similar to MUT circuit 500 and, as a result, utilizes the same reference numbers to designate the elements which are common to both MUT circuits.

As shown in FIG. 6, MUT circuit 600 differs from MUT circuit 500 in that MUT circuit 600 utilizes a transmit circuit 610 in lieu of transmit circuit 510, and a digital signal processing circuit 612 in lieu of digital signal processing circuit 512. Transmit circuit 610 is the same as transmit circuit 510, except that transmit circuit 610 omits controller 330 and memory 332. In addition, user control is passed directly to digital signal processing circuit 612.

In operation, digital signal processing circuit 612 of MUT circuit 600 performs a calibration procedure to identify the transmit signal that produces a digitized signal that matches the digitized golden signal (within an error tolerance) in the same manner that digital signal processing circuit 512 identifies the transmit signal to be stored in memory 332.

However, unlike MUT circuit 500, digital signal processing circuit 612 of MUT circuit 600 continues to compare every digitized signal to the digitized golden signal, and can adjust the digital values that are output by digital signal processing circuit 612 as needed each time a transmit signal is to be output.

Thus, in addition to performing a start-up or commanded calibration to determine the transmit signal that will move MUT membrane 312 in the desired manner, MUT circuit 600 continuously monitors the movement of MUT membrane 312 and compares that movement to digital values that represent the desired movement of MUT membrane 312.

It should be understood that the above descriptions are examples of the present invention, and that various alternatives of the invention described herein may be employed in practicing the invention. Thus, it is intended that the following claims define the scope of the invention and that structures and methods within the scope of these claims and their equivalents be covered thereby.

What is claimed is:

1. A micromachined ultrasonic transducer (MUT) circuit comprising:

a membrane; and a transmit circuit connected to the membrane, the transmit circuit configured to output a transmit signal to the membrane to transfer energy to the membrane, the transmit signal having an initial waveform that transfers an initial amount of energy that causes the membrane to first move in a first direction to a first position, and then move in a second direction opposite the first direction from the first position to a second position, the transmit signal having, after the initial waveform, an additional waveform that transfers an additional amount of energy to the membrane, the initial and additional amounts of energy being different, and the transmit signal having, after the additional waveform, a cancellation waveform that transfers a cancellation amount of energy to the membrane, wherein said initial waveform and said additional waveform and said cancellation waveform are voltage waveforms that each begins at a common reference voltage level, and then moves from said common reference voltage level to a another voltage level, and then returns to end at said common reference voltage level.

2. The MUT circuit of claim 1 wherein: the membrane moves in the first direction a number of times after receiving the initial amount of energy; and the additional amount of energy is transferred to the membrane before the membrane has moved the number of times in the first direction.

3. The MUT circuit of claim 1 wherein the additional amount of energy is less than the initial amount of energy.

4. The MUT circuit of claim 1 wherein the additional amount of energy is transferred to the membrane while the membrane is moving in the first direction.

5. The MUT circuit of claim 1 wherein the membrane moves in the first direction from the second position to substantially the first position in response to the additional amount of energy.

6. The MUT circuit of claim 1 wherein an additional amount of energy and the cancellation amount of energy are different.

7. The MUT circuit of claim 1 wherein the cancellation amount of energy is greater than the additional amount of energy.

8. The MUT circuit of claim 1 wherein the cancellation waveform transfers the cancellation amount of energy when the membrane moves in the second direction.

9. The MUT circuit of claim 1 wherein the cancellation amount of energy substantially stops a movement of the membrane.

10. The MUT circuit of claim 1 and further comprising a receive circuit electrically connected to receive an output signal that is generated by a movement of the membrane, and generate a digitized signal that represents the output signal.

11. The MUT circuit of claim 10 wherein the digitized signal corresponds with the transmit signal.

12. The MUT circuit of claim 10 and further comprising a processing circuit that is electrically connected to the transmit circuit and the receive circuit, the processing circuit to compare the digitized signal to a digitized golden signal.

13. The MUT circuit of claim 12 wherein the transmit circuit includes a memory, the processor to store a series of digital values in the memory that represent the transmit signal when the digitized signal matches the digitized golden signal within an error tolerance.

14. The MUT circuit of claim 12 wherein when the digitized signal fails to match the digitized golden signal within the error tolerance, the processor changes the series of digital values output by the processor to generate a different transmit signal, and continues generating different transmit signals until a digitized signal matches the digitized golden signal within the error tolerance.

15. The MUT circuit of claim 14 wherein the transmit circuit includes a memory, the processor to store a series of digital values in the memory that represent a matching transmit signal when a digitized signal matches the digitized golden signal within an error tolerance.

16. The MUT circuit of claim 14 wherein when the processor compares every digitized signal to the digitized golden signal.

17. A method of transducing comprising:

transferring an initial amount of energy with an electrical signal to a membrane of a micromachined ultrasonic transducer to cause the membrane to move initially in a first direction to a first position, and then move in a second direction opposite the first direction from the first position to a second position;

transferring an additional amount of energy to the membrane with the electrical signal after said transferring the initial amount of energy, the initial and additional amounts of energy being different, and transferring a cancellation amount of energy to the membrane with the electrical signal after said transferring the additional amount of energy;

wherein said initial amount of energy and said additional amount of energy and said cancellation amount of energy are transferred by respectively associated voltage waveforms of the electrical signal that each begins at a common reference voltage level, and then moves from said common reference voltage level to a another voltage level, and then returns to end at said common reference voltage level.

18. The method of claim 17 wherein: the membrane moves in the first direction a number of times after receiving the initial amount of energy; and the additional amount of energy is transferred to the membrane before the membrane has moved the number of times in the first direction.

19. The method of claim 17 wherein the additional amount of energy is less than the initial amount of energy.

20. A transducing system, comprising:

means for transferring an initial amount of energy with an electrical signal to a membrane of a micromachined ultrasonic transducer to cause the membrane to move initially in a first direction to a first position, and then move in a second direction opposite the first direction from the first position to a second position;

means for transferring an additional amount of energy to the membrane with the electrical signal after said transferring the initial amount of energy, the initial and additional amounts of energy being different, and means for transferring a cancellation amount of energy to the membrane with the electrical signal after said transferring the additional amount of energy;

wherein said initial amount of energy and said additional amount of energy and said cancellation amount of energy are transferred by respectively associated voltage waveforms of the electrical signal that each begins at a common reference voltage level, and then moves from said common reference voltage level to a another voltage level, and then returns to end at said common reference voltage level.

* * * * *